US009187899B2

(12) United States Patent
Nam

(10) Patent No.: US 9,187,899 B2
(45) Date of Patent: Nov. 17, 2015

(54) COMPOSITE PANEL AND A PRODUCTION METHOD THEREFOR

(75) Inventor: Seung Baik Nam, Cheongju-si (KR)

(73) Assignee: LG HAUSYS, LTD., Seoul (KR)

( * ) Notice: Subject to any disclaimer, the term of this patent is extended or adjusted under 35 U.S.C. 154(b) by 931 days.

(21) Appl. No.: 13/393,721

(22) PCT Filed: Nov. 22, 2010

(86) PCT No.: PCT/KR2010/008257

§ 371 (c)(1),
(2), (4) Date: Mar. 1, 2012

(87) PCT Pub. No.: WO2011/065713

PCT Pub. Date: Jun. 3, 2011

(65) Prior Publication Data

US 2012/0156438 A1 Jun. 21, 2012

(30) Foreign Application Priority Data

Nov. 24, 2009 (KR) ..... 10-2009-0114109

(51) Int. Cl.

| | |
|---|---|
| ***B32B 3/00*** | (2006.01) |
| ***B23P 11/00*** | (2006.01) |
| ***E04C 2/26*** | (2006.01) |

(Continued)

(52) U.S. Cl.

CPC ..... *E04C 2/26* (2013.01); *E04F 13/144* (2013.01); *E04F 15/082* (2013.01); *E04C 2/288* (2013.01); *E04C 2/38* (2013.01); *E04F 15/02038* (2013.01); *E04F 15/188* (2013.01); *E04F 2201/0107* (2013.01); *Y10T 29/49826* (2015.01);

(Continued)

(58) Field of Classification Search

CPC ..... Y10T 428/24612; Y10T 428/166; Y10T 428/167; Y10T 29/49826; E04C 2/26; E04C 2/288; E04C 2/38; E04F 13/144; E04F 13/0866; E04F 15/082; E04F 15/02038; E04F 15/188; E04F 2201/0107

See application file for complete search history.

(56) References Cited

U.S. PATENT DOCUMENTS

| | | | | |
|---|---|---|---|---|
| 2,030,556 | A | 2/1936 | Veltung | |
| 5,208,086 | A * | 5/1993 | Owens | 428/47 |
| 5,444,955 | A * | 8/1995 | Ou | 52/309.9 |

FOREIGN PATENT DOCUMENTS

| | | | |
|---|---|---|---|
| CN | 2612753 | Y | 4/2004 |
| DE | 202004020996 | U1 | 8/2006 |
| JP | H01165864 | A | 6/1989 |
| JP | H3-130840 | U | 12/1991 |
| JP | H4-20550 | U | 2/1992 |
| JP | H05-086709 | A | 4/1993 |

(Continued)

OTHER PUBLICATIONS

WO 2008/089414, Elmer et al, Jul. 2008.*

*Primary Examiner* — Donald J Loney

(74) *Attorney, Agent, or Firm* — Nath Goldberg & Meyer; Joshua B. Goldberg; Scott H. Blackman

(57) ABSTRACT

The present invention relates to a composite panel comprising: a surface-material layer; a substrate layer formed on the surface-material layer; and a profile which has the shape of a polygonal frame, receives the surface-material layer on the inside, is formed with a slot-in projection on at least one side and is formed with a slot-in recess on at least one side, and relates to a production method for the composite panel. The present invention can provide a composite material which entails a straightforward construction method and which can maintain a high degree of thermal conductivity and can minimize level differences in the constructed product surface, and provide a production method for the composite panel.

8 Claims, 2 Drawing Sheets

(51) Int. Cl.

| | |
|---|---|
| ***E04F 13/14*** | (2006.01) |
| ***E04F 15/08*** | (2006.01) |
| *E04C 2/288* | (2006.01) |
| *E04C 2/38* | (2006.01) |
| *E04F 15/02* | (2006.01) |
| *E04F 15/18* | (2006.01) |

(52) U.S. Cl.
CPC ..... *Y10T428/166* (2015.01); *Y10T 428/167* (2015.01); *Y10T 428/24612* (2015.01)

(56) References Cited

FOREIGN PATENT DOCUMENTS

| | | | |
|---|---|---|---|
| JP | 2005502800 | A | 1/2005 |
| KR | 20-0365680 | Y1 | 10/2004 |
| KR | 10-0470497 | B1 | 3/2005 |
| KR | 20-0381699 | Y1 | 4/2005 |
| KR | 10-0651581 | B1 | 11/2006 |
| WO | 03/036000 | A1 | 5/2003 |
| WO | 03/040491 | A1 | 5/2003 |
| WO | 2005/072957 | A1 | 8/2005 |

* cited by examiner

COMPOSITE PANEL AND A PRODUCTION METHOD THEREFOR

CROSS-REFERENCE TO RELATED APPLICATIONS

This application is based upon and claims the benefit of priority from Korean Patent Applications No. 10-2009-0114109, filed on Nov. 24, 2009, the entire contents of which are incorporated herein by reference.

TECHNICAL FIELD

The present disclosure relates to a composite panel and a manufacturing method thereof.

BACKGROUND

Generally, panels made of ceramic tiles, steel sheets or reinforced plastics are mainly used as a finishing material of a wall or a floor.

In recent years, as consumers' interest in interior decoration increases because of improvement in income level, the use of interior decoration materials such as various interior/exterior materials, especially natural marble, has become popular to create differentiated luxurious environments. However, natural marble has the following problems.

First, natural marble is disadvantageous in terms of cost. Marble itself is expensive as compared to other materials. Further, since marble requires special equipment or skilled stonemasons during treatment such as a carrying operation or a cutting operation, labor cost is included in the cost of marble panels and thus marble panels become very expensive. Thereby, natural marble panels are not widely used as a finishing material but are limitedly applied to some costly buildings.

Second, natural marble is disadvantageous in terms of material characteristics. Marble is heavy and brittle in comparison with other materials. Thus, in the case of forming a wall or floor using marble panels, it is likely to separate or break.

In order to solve such problems, a composite panel has been proposed, which combines natural marble with a substrate. However, the conventional composite panel is problematic in that a wet process is carried out using cement or mortar during composite-panel construction, and a sealing material such as white cement is applied between respective layers of the composite panel, so that construction efficiency is low and construction cost increases. Further, a product is placed on the cement or mortar that is provided on a construction surface for the construction, thus causing a level difference on a composite panel surface. In order to overcome the problem, a gap filling process is performed using the sealing material. In this case, resistance to a pollution source produced in daily life is lowered.

SUMMARY

Accordingly, the present invention has been made keeping in mind the above problems occurring in the prior art, and an object of the present invention is to provide a composite panel and a manufacturing method thereof, which make a construction method simple, maintain high thermal conductivity, and minimize a level difference on a surface of a constructed product.

The present disclosure provides a composite panel including a surface-material layer, a substrate layer formed on the surface-material layer, and a profile.

The profile has a shape of a polygonal frame, receives the substrate layer therein, and includes a fitting projection formed on at least one side thereof and a fitting recess formed in at least one side thereof.

The present disclosure provides a method for manufacturing a composite panel including a first step of attaching a surface-material layer to a substrate layer, and a second step of inserting the substrate layer attached to the surface-material layer into a profile.

The profile has a shape of a polygonal frame, and includes a fitting projection formed on at least one side thereof and a fitting recess formed in at least one side thereof.

The present disclosure provides a method for manufacturing a composite panel including (1) inserting a substrate layer into a profile, the profile having a shape of a polygonal frame and including a fitting projection formed on at least one side thereof and a fitting recess formed in at least one side thereof.

The method also includes (2) attaching the profile having the substrate layer inserted at (1) to a bottom of a surface-material layer.

Advantageous Effects

A composite panel according to the present invention enables construction by inserting a fitting projection of a profile into a fitting recess, thus allowing the construction to be performed in simple and efficient ways. Further, the composite panel is advantageous in that a level difference is minimized after construction, use of a sealing material is unnecessary, and heating efficiency is high because of good thermal conductivity of a substrate.

DETAILED DESCRIPTION

The present invention is directed to a composite panel including a surface-material layer, a substrate layer formed on the surface-material layer, and a profile.

The profile takes a shape of a polygonal frame and receives the substrate layer therein. A fitting projection is formed on at least one side of the profile, and a fitting recess is formed in at least one side of the profile.

Hereinafter, the composite panel of the present invention will be described in more detail.

Figure 1:
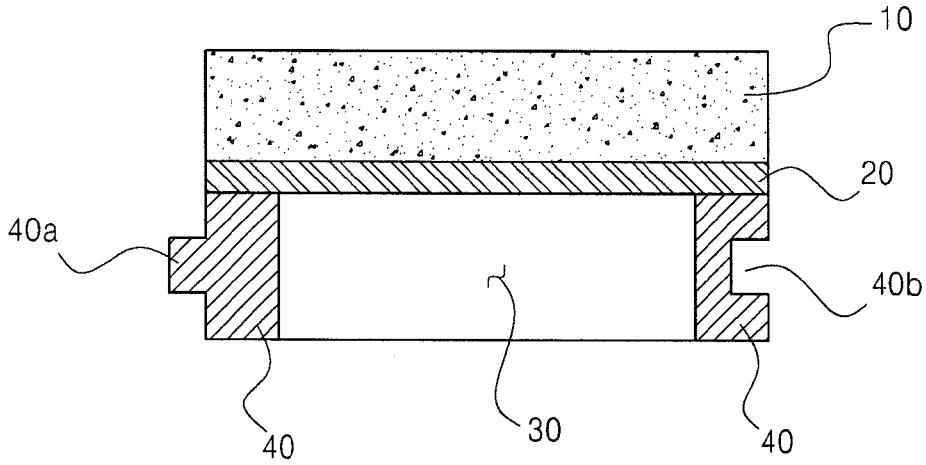
FIG. 1 is a sectional view showing a composite panel according to the present invention.

As shown in FIG. 1, the composite panel of the present invention may include a surface-material layer 10, a substrate layer 30 formed under the surface-material layer, and a profile 40 taking a shape of a polygonal frame and receiving the substrate layer therein. A fitting projection is formed on at least one side of the profile, and a fitting recess is formed in at least one side of the profile.

In the present invention, the surface-material layer forms an uppermost layer when the composite panel is attached to a floor. The surface-material layer may comprise natural stone or artificial stone without being limited to a specific material. According to the present invention, it is preferable that the surface-material layer comprises natural stone. Natural stone provides an antique and graceful effect. Particularly, natural stone transmits light to provide an indirect lighting effect. To be specific, an example of natural stone may be marble, granite stone, limestone or sandstone, but is not limited thereto.

According to the present invention, an area of the surface-material layer is appropriately selected to conform to a size of the floor to which the composite panel is to be applied, for example, may range from 1000 $cm^2$ to 8000 $cm^2$. Further, a length and a width of the surface-material layer may be adjusted to be within a range of 400 mm to 800 mm.

Further, in the present invention, a thickness of the surface-material layer is not limited to a specific value, for example, it may range from 2 mm to 5 mm. If the thickness of the surface-material layer is less than 2 mm, strength is reduced, so that the surface-material layer may be damaged. On the other hand, if the thickness is more than 5 mm, a manufacturing cost may be increased.

In the present invention, the substrate layer is formed under the surface-material layer to support the surface-material layer. The substrate layer is preferably formed such that a central portion of the substrate layer is aligned with a central portion of a bottom of the surface-material layer.

The substrate layer must be excellent with respect to impact resistance, and must not be deformed, bent, twisted or cracked due to humidity. Further, the substrate layer must complement brittle properties of the surface-material layer disposed on the front, in addition to being resistant to deformation caused by environment. Moreover, in order to enhance heating efficiency, the substrate layer must have good thermal conductivity at room temperature.

Here, it is preferable that the substrate layer have a thermal conductivity of 0.15 watt/m-K or more at room temperature. It is more preferable that the substrate layer have a thermal conductivity of 0.2 watt/m-K or more. A maximum value of the thermal conductivity may be 5 watt/m-K without being limited to a specific value. The maximum value may be preferably 3 watt/m-K, and may be more preferably 1 watt/m-K. When a product having the thermal conductivity of 0.15 watt/m-K or more is used as the substrate layer, heat is easily transferred from the floor to the surface-material layer, thus enhancing the heating efficiency.

The term used in the present invention, 「room temperature」, means a normal temperature that does not noticeably increase or decrease a temperature, for example, temperature around 15□ to 35□, specifically 20□ to 25□, and more specifically 25□. Further, in the present invention, the thermal conductivity may be measured by a general method, for example, in accordance with ASTM E1530.

The substrate layer is not limited to a specific material. According to the present invention, it is preferable that ceramic be used as the substrate layer. Since ceramic is light in weight and is excellent in thermal conductivity, heat can be easily transferred from the floor through the ceramic substrate layer to the surface-material layer.

The ceramic may use a calcium silicate board, a magnesium board, a ceramic board, a porcelain board, etc.

The substrate layer is not limited to a specific shape, and may have a shape of a rectangular plate for example.

The substrate layer must be included in an area of the surface-material layer. Further, the width and length of the substrate layer must be smaller than the width and length of the surface-material layer. For example, the width and length of the substrate layer may be adjusted, respectively, within a range from 380 mm to 780 mm. If the width or length of the substrate layer is less than 380 mm, a support effect may be deteriorated. In contrast, if the width or length of the substrate layer is more than 780 mm, it may be difficult to perform construction.

Preferably, in the present invention, the area of the substrate layer occupies 48% to 97% of that of the surface-material layer. If the area of the substrate layer is less than 48% of that of the surface-material layer, heat may not be easily transferred. If the area is more than 97%, it is difficult to manufacture the profile that will be described below.

Further, the substrate layer preferably has a thickness from 5 mm to 20 mm. If the thickness of the substrate layer is less than 5 mm, strength for supporting the surface-material layer is reduced, and it is difficult to form the fitting projection and the fitting recess that will be described later. If the thickness is more than 20 mm, it occupies a larger space, so that a material cost may be increased.

The profile of the present invention is formed under the surface-material layer, and receives the substrate layer therein. Further, the profile has on at least one side thereof the fitting projection and the fitting recess.

The profile is not limited to a specific material. For example, the profile may comprise one of synthetic resin, wood and metal or a mixture thereof.

A specific example of the synthetic resin includes Poly Vinyl Chloride (PVC), Ploy Ethylene (PE), Ploy Ethylene Terephthalate (PET), Ploy Ethylene Terephthalate Glycolmodifieid (PETG), High Impact Polystyrene (HIPS), Acrylonitrile Butadiene Styrene (ABS), Poly Urethane (PU), Styrene Butadiene Styrene (SBS) block Copolymer, Styrene Ethylene Butadiene Styrene (SEBS) block Copolymer, Syndiotactic Poly Styrene (SPS), Styrene Ethylene Propylene Styrene (SEPS) block Copolymer, etc. A specific example of the wood includes water proof plywood, a strand board, a particle board, a Medium Density Fiberboard (MDF), a High Density Fiberboard (HDF), a Wood Fiber Plastic Composite (WFPC), etc. A specific example of the metal includes aluminum.

The profile is not limited to a specific shape, but preferably has a shape of a polygonal frame. Particularly, it is preferable that the profile have a shape of a picture-frame with four sides.

The picture-frame is hollow therein. The interior thereof may have a shape that conforms to that of the substrate layer to receive the substrate layer.

Figure 2:
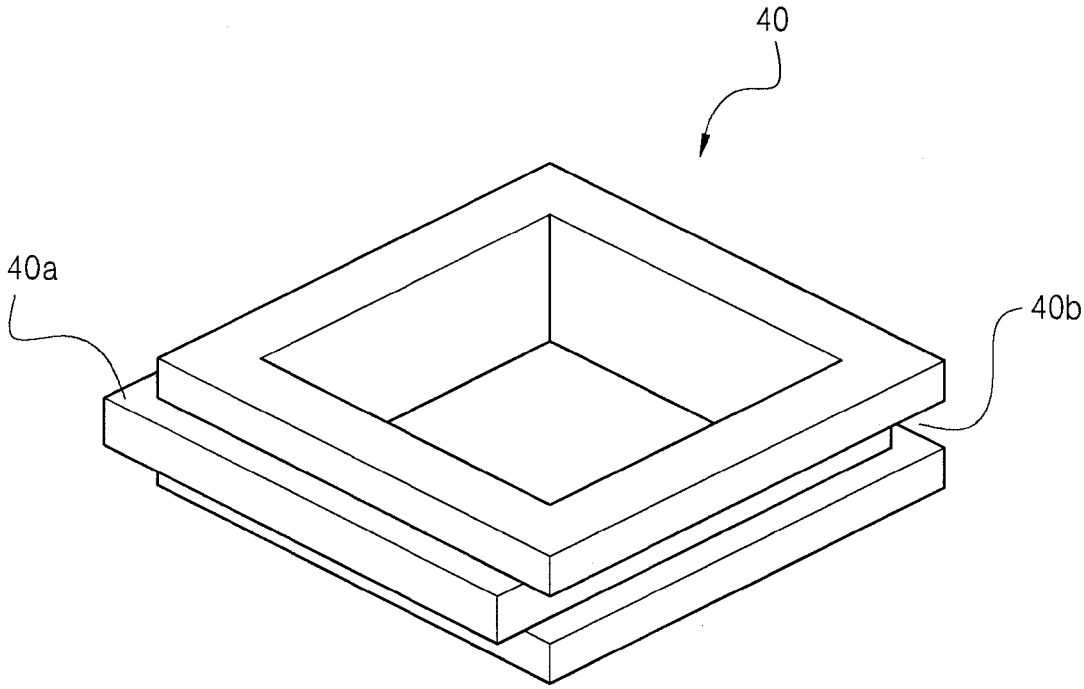
FIG. 2 is a view showing a picture-frame-type profile of the present invention.

The profile may have a fitting projection and a fitting recess that are formed, respectively, on at least one side thereof. For example, when the profile has a shape of a rectangular picture-frame as shown in FIG. 2, a fitting projection 40*a* may be continuously formed on two of four sides, and a fitting recess 40*b* may be continuously formed on the remaining two sides. That is, the fitting projection 40*a* may be formed on one side of the profile, while the fitting recess 40*b* may be formed on the other side of the profile.

Figure 3:
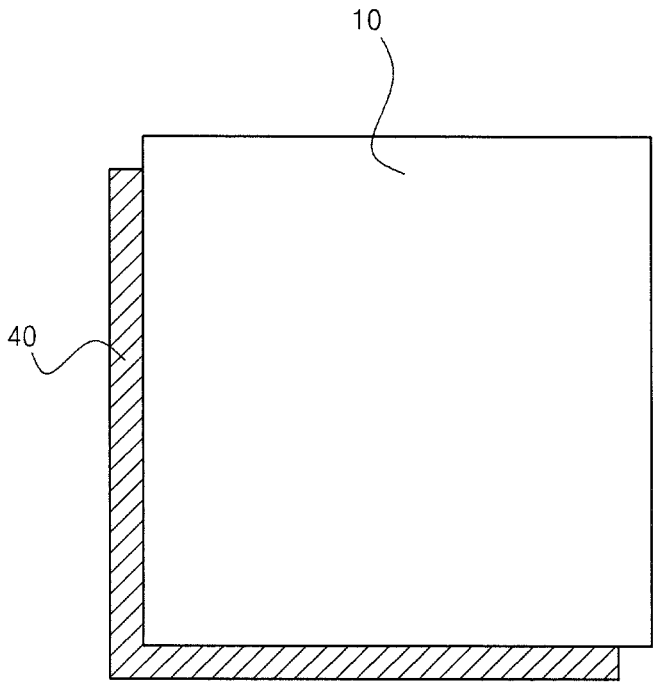
FIG. 3 is a top plan view showing the composite panel according to an embodiment of the present invention.
Figure 4:
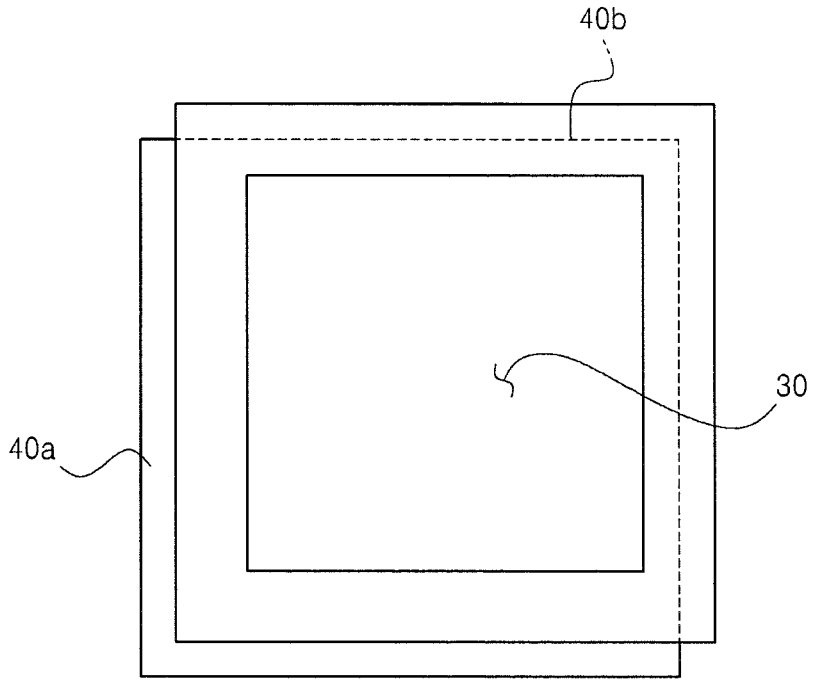
FIG. 4 is a bottom plan view showing the composite panel according to the embodiment of the present invention.

In the present invention, FIGS. 3 and 4 are a top plan view and a bottom plan view of the composite panel, respectively. The fitting projection may be continuously formed on two of the four sides of the profile, and the fitting recess may be continuously formed on the remaining two sides.

By forming the fitting projection and the fitting recess on the profile, the fitting projection of the profile is fitted into the fitting recess of a neighboring profile during the construction of the composite panel, thus enabling coupling to be performed more easily and firmly.

In order to increase the coupling strength of the fitting projection and the fitting recess by fitting, the fitting projection and the fitting recess may further include a locking means. That is, a locking step (not shown) is formed on the fitting projection, and a locking groove (not shown) is formed in the fitting recess, so that the locking step engages with the locking groove when the fitting projection is fitted into the fitting recess, thus preventing the fitting projection from being unexpectedly removed from the fitting recess and enabling coupling to be performed more firmly.

The locking step and the locking groove may be formed to have corresponding shapes at corresponding positions.

When the profile is shaped like a picture-frame, the width and length of the profile may be equal to the width and length of the above-mentioned surface-material layer. As such, when the width and length of the profile are set to be equal to the width and length of the surface-material layer, the construction is convenient and composite panels are attached to each other in a uniform fashion after the construction has been completed, so that it is unnecessary to use a sealing material.

Further, it is preferable that the profile have a width from 10 mm to 100 mm. If the width of the profile is less than 10 mm, it may be difficult to form the fitting recess on a side. On the other hand, if the width is more than 100 mm, thermal conductivity may be lowered.

It is preferable that the thickness of the profile be the same as the thickness of the substrate layer. If the thickness of the profile is the same as the thickness of the substrate layer, the loosening of the composite panel is prevented after the construction has been completed, in addition to guaranteeing firm construction.

In the present invention, the profile may have shapes other than the shape of the picture-frame if necessary. For example, the profile may comprise two 'L'-shaped profiles or four straight-line-shaped profiles. The profile has the fitting projection or the fitting recess on each side thereof. When the composite panel is manufactured, two continuous sides may have the fitting projection, and the remaining two sides may have the fitting recess.

According to the present invention, an adhesive layer may be further provided between the surface-material layer, the substrate layer and the profile. The adhesive layer is not limited to specific composition, and may be composed of one of an epoxy-based adhesive, a polyester-based adhesive or an acryl-based adhesive, or a mixture thereof. In the present invention, it is preferable that the adhesive layer comprise the epoxy-based adhesive. The epoxy-based adhesive is excellent in terms of constructability, weather resistance, adhesive properties, and strength.

Further, the present invention is directed to a method for manufacturing the composite panel.

The method for manufacturing the composite panel is not limited to a specific process. For example, the method may include a first step of attaching the surface-material layer to the substrate layer, and a second step of inserting the substrate layer attached to the surface-material layer into the profile.

The profile takes the shape of a polygonal frame, has the fitting projection on at least one side thereof, and has the fitting recess on at least one side thereof.

At the first step, the surface-material layer is attached to the substrate layer. Here, the surface-material layer may be attached to the substrate layer such that the central portion of the surface-material layer is aligned with the central portion of the substrate layer. When the surface-material layer is attached to the substrate layer, an adhesive may be used.

At the second step, the substrate layer attached to the surface-material layer at the first step is inserted into the profile, thus manufacturing the composite panel.

Here, the profile preferably has the shape of a picture-frame, and may be formed as an injection molded product. When the profile is formed to have an 'L' shape, the profile may be formed by injection molding. Meanwhile, when the profile is formed to have a straight-line shape and then is assembled, the profile may be formed by extruding.

The substrate layer may be attached to the profile using an adhesive.

Further, the method for manufacturing the composite panel may include a step (1) of inserting the substrate layer into the profile, and a step (2) of attaching the profile having the substrate layer inserted therein to the bottom of the surface-material layer.

The profile has a shape of a polygonal frame. The fitting projection is formed on at least one side of the profile, and the fitting recess is formed in at least one side of the profile.

At step (1), the substrate layer is inserted into the profile to be accommodated therein. During the insertion, an adhesive may be used.

At step (2), the profile having the substrate layer inserted therein at step (1) is attached to the bottom of the surface-material layer. During the attachment, an adhesive may be used. The surface-material layer may be equal in size to the profile.

Embodiment

Hereinafter, although the present invention will be described in more detail with reference to an embodiment, it should be understood that the scope of the present invention is not limited to the embodiment which will be described below.

First Embodiment

A square porcelain board that is 580 mm in length and 9 mm in thickness is attached to a back of a square natural marble layer that is 600 mm in length and 3 mm in thickness, using an epoxy-based adhesive. Here, the porcelain board is aligned with a center of the natural marble layer and then is attached to the natural marble layer. Opposite sides of the back of the marble layer each having a length of 10 mm are not attached to the porcelain board and are open.

After the adhesive for attaching the natural marble layer to the porcelain board is sufficiently hardened, a profile is integrally coupled to the bottom of the natural marble layer with the epoxy-based adhesive, thus manufacturing the composite panel. The profile has a shape of a rectangular picture-frame, is 600 mm in length, is 9 mm in thickness, and is made of an ABS resin to have a fitting projection and a fitting recess on each side.

Table 1 shows thermal conductivity, level difference, and use of the sealing material concerning the manufactured composite panel.

Here, the thermal conductivity is measured in accordance with the ASTM E1530.

First Comparative Example

A composite panel is manufactured in the same method as the first embodiment. A porcelain board having the same size as marble is attached to the back of a natural marble layer, and a side of the porcelain board is formed to be flat without a fitting projection and a fitting recess.

Table 1 shows thermal conductivity, level difference, and use of the sealing material concerning the composite panel manufactured in this way.

TABLE 1

| | 1st embodiment | 1st comparative example |
|---|---|---|
| Thermal Conductivity (watt/m-k) | 0.229 | 0.231 |
| Level Difference (mm) | Within 1.0 | Within 3.0 |
| Use of Sealing Material | X | ○ |

As shown in Table 1, when comparing the composite panel of the first embodiment with the composite panel of the first comparative example, the former composite panel is lower in level difference and does not require the use of the sealing material. Consequently, it can be seen that the composite panel having the profile with the fitting projection and the fitting recess is lower in level difference and eliminates the necessity of using the sealing material.

What is claimed is:

1. A composite panel, comprising:

i) a surface-material layer;

ii) a substrate layer formed under the surface-material layer and aligned with a central portion of a bottom of the surface-material layer, wherein the substrate layer is made of ceramic and has thermal conductivity of 0.15 watt/m-K or more at room temperature;

iii) a profile formed on the periphery of a bottom of the surface-material layer and having a shape of a polygonal frame, receiving the substrate layer therein, and including a fitting projection formed on at least one side thereof and a fitting recess formed in at least one other side thereof, wherein the profile is made of synthetic resin; and iv) a shape of the profile conforms to that of the surface-material layer.

2. The composite panel of claim 1, wherein the surface-material layer comprises natural stone.

3. The composite panel of claim 1, wherein the surface-material layer has an area from 1000 $cm^2$ to 8000 $cm^2$.

4. The composite panel of claim 1, wherein an area of the substrate layer is 48% to 97% of that of the surface-material layer.

5. The composite panel of claim 1, wherein the substrate layer has a thickness from 5 mm to 20 mm.

6. The composite panel of claim 1, wherein the profile includes four sides, with the fitting projection being formed on two continuous sides and the fitting recess being formed on two remaining continuous sides.

7. A method for manufacturing a composite panel, comprising:

a first step of attaching a surface-material layer to a ceramic substrate layer having thermal conductivity of 0.15 watt/m-K or more at room temperature, aligning the ceramic substrate layer with a central portion of a bottom of the surface-material layer; and a second step of inserting the ceramic substrate layer attached to the surface-material layer into a profile made of synthetic resin and formed on the periphery of a bottom of the surface-material layer, the profile having a shape of a polygonal frame and including a fitting projection formed on at least one side thereof and a fitting recess formed in at least one other side thereof.

8. A method for manufacturing a composite panel, comprising:

(1) inserting a ceramic substrate layer having thermal conductivity of 0.15 watt/m-K or more at room temperature into a profile made of synthetic resin, the profile having a shape of a polygonal frame and including a fitting projection formed on at least one side thereof and a fitting recess formed in at least one other side thereof; and (2) aligning the profile having the ceramic substrate layer inserted at (1) with a bottom of a surface-material layer so that the ceramic substrate layer aligns with a central portion of the surface-material layer, and (3) attaching the profile having the ceramic substrate layer inserted at (1) to the bottom of the surface-material layer.

* * * * *